United States Patent [19]

Caraway et al.

[11] Patent Number: 4,697,639

[45] Date of Patent: Oct. 6, 1987

[54] BLOW-OUT PROTECTOR AND FIRE CONTROL SYSTEM FOR PETROLEUM EXPLORATION

[75] Inventors: Miles F. Caraway; Bobby L. Caraway, both of Shreveport, La.

[73] Assignee: Fire-Fox International, Inc., Hinton, W. Va.

[21] Appl. No.: 851,085

[22] Filed: Apr. 14, 1986

[51] Int. Cl.[4] ..... E21B 33/03; E21B 33/06

[52] U.S. Cl. ..... 166/82; 166/84; 166/88; 166/387; 166/196

[58] Field of Search ..... 166/8 L, 84, 86, 88, 166/90, 373, 387, 196; 251/1.1, 1 L

[56] References Cited

U.S. PATENT DOCUMENTS

| | | | |
|---|---|---|---|
| 3,692,106 | 9/1972 | Basham et al. | 166/66 X |
| 3,840,072 | 10/1974 | Hutchinson | 166/86 |
| 4,326,584 | 4/1982 | Watkins | 166/84 X |
| 4,440,236 | 4/1984 | LeMoine | 166/373 |

*Primary Examiner*—Stephen J. Novosad
*Attorney, Agent, or Firm*—Richard C. Litman

[57] ABSTRACT

A blow-out protector and fire control system is located in a rotating Kelly flange assembly and flange housing. The blow-out protector is based upon compressing a rubber Kelly bushing and seal positioned around a rotating Kelly by upward movement of a catch ring on the rotating Kelly. The catch ring forces a compressor ring positioned below the rubber bushing upward causing the rubber bushing to form a seal between the Kelly and the rotating Kelly flange assembly. The fire control system involves injecting an inert gas through an opening in the Kelly flange housing into the well casing, and removing high pressure fluid sequentially through the same opening. As an alternative, high pressure fluid can be removed from the well pipe simultaneously. The high pressure fluid is piped to a location remote from the well for storage or flaring.

7 Claims, 2 Drawing Figures

BLOW-OUT PROTECTOR AND FIRE CONTROL SYSTEM FOR PETROLEUM EXPLORATION

BACKGROUND OF THE INVENTION

The present invention relates to a blow-out protector and fire control system for petroleum exploration.

Blow-out protectors are well known. In general, they are valve devices which are designed to pack off the annular space between the drill pipe and the well casing, or a blow-out protector housing which forms an extension of the casing, in the event of a blow-out. A typical blow-out protector comprises, as its essential components, an elastomeric body which performs as a packing component and an exteriorly operated actuator means which acts on the packing element and forces it into sealing arrangement between the drill pipe and the casing or housing. Usually, the blow-out protector includes or is associated with some means of sensing or reacting to an increase of pressure in the well hole and is designed such that the protector is actuated and the well pressure is controlled before the well pressure can do substantial damage to the drilling equipment or cause injury at the drilling site.

One example of a blow-out protector is illustrated in U.S. Pat. No. 2,231,221. In that protector, the packing element is carried on an elongated actuator sleeve provided with a plurality of annular gear teeth. In the event of a blow-out the packing element is driven by the sleeve into abutment with a shoulder located internally in the well hole whereupon the packing element is compressed and the packing buldges from the element into sealing arrangement between the drill pipe and the blow-out protector housing. There are numerous other examples of blow-out protectors in the art which differ in the design of the packing element and the means whereby the element if forced into sealing engagement with the drill pipe. For example see U.S. Pat. Nos. 3,804,174; 2,375,432; 2,139,526; and 1,963,683.

Should the blow-out protector fail, as sometimes happens, catastrophic results ensue. The proposed solution set forth in U.S. Pat. No. 3,804,175 is to increase the pressure in the blow-out protector annulus which in turn forces the elastomeric body of the blow-out protector against the outer wall of the drill string. It would appear however that if a channel were to form between the drill string wall and the elastomeric body that the body could be forced away from the drill string. In addition, increased pressure in the well can put increased stress on the sealing elements of the well and cause a blow-out. Another proposed solution to the blow-out protector failure problem is to mix the oil and the flamable and toxic gases shooting out of the well with liquids which absorb the toxic gases and prevent combustion, see U.S. Pat. No. 4,316,506. This blow-out condition of the well is preferably avoided, as it is very difficult to reseal a well in a blow-out state.

Another factor contributing to a blow-out state is the inability of most blow-out protectors to function when the well pipe has been pulled from the well, as the blow-out protectors work by forcing a rubber body in sealing relationship between the well pipe and casing.

SUMMARY OF THE INVENTION

The present invention overcomes the above enumerated problems of the prior art by reducing pressure build up prior to a blow-out, by providing a means for sealing the well after the well pipe has been removed, by providing a means for injecting a non-flamable gas into the well, and by providing a positive means for sealing the well when it appears that a blow-out is about to appear during drilling operations.

The blow-out protector of the present invention includes blow-out protector housing having a vertical passageway therethrough for a drill pipe. The term "drill pipe is used in its broad sense and includes both a pipe of the drill string and the Kelly, but preferably the Kelly. The housing is an extension of the well casing having upper and lower ends adaptated to be connected to the well casing. A packer, which is an elastomeric body having an opening for the drill pipe, is carried in the housing. When the elastomeric body is vertically compressed it provides sealing contact between the drill pipe extending through the housing and the inner wall of the housing. A compressor plate is positioned below the elastomeric body. The compressor plate is positioned horizontally and has a hole through its horizontal surface for passage of the drill pipe. A catch ring is positioned on the drill pipe below the compressor plate. The diameter of the hole of the compressor plate is smaller than the diameter of the catch ring on the drill pipe so that when the drill pipe is pulled up the catch ring will contact and force the compressor plate against the elastomeric body and force the elastomeric body into tight contact with both the drill pipe and the inner wall of the housing thus sealing the space between the drill pipe and the housing against a blow-out.

Optionally, a lateral fluid conduit is positioned on the housing below the elastomeric body. One or more storage tanks, valves and pipes are used for introducing a non-flamable fluid into the lateral fluid conduit if sensors on the blow-out protector indicate a blow-out or a fire. In addition, storage tanks and flares are also in valved communication with the lateral fluid conduit for withdrawing fluid from the lateral fluid conduit to relieve the pressure between the casing and the drill pipe. The introduction of the non-flamable fluid and withdrawing of flammable fluid for storage is sequential and not simultaneous. In the normal course of events, pressurized carbon dioxide would first be introduced into the well casing for fire control and then if pressure build up reached a critical level, oil and gas in the casing would be piped away from the well for flaring and or storage. The flaring or storage would preferably occur at a site remote from the well.

Simultaneous fire control and blow-out protection can be achieved in accordance with the present invention by injecting a fire extinguishing fluid into the lateral opening and withdrawing flammable fluid from the well pipe. Again storing or flaring the flammable fluid which was withdrawn, preferably at a remote site.

The horizontal cross sectional configuration of blow-out protector housing, the elastomeric body and the compressor plate is preferably circular, though other shapes could also be used.

The fire control system of the present invention can also be used without the elastomeric body or packer. This would involve introducing a non-flamable fluid into the lateral fluid conduit, and withdrawing fluid from the lateral fluid conduit. Again the introducing and the withdrawing would be sequential and not simultaneous. Simultaneous introduction and withdrawal can again be accomplished by injecting a non-flamable fluid in the lateral opening and withdrawing flammable fluid from the drill pipe.

DETAILED DESCRIPTION

Figure 1:
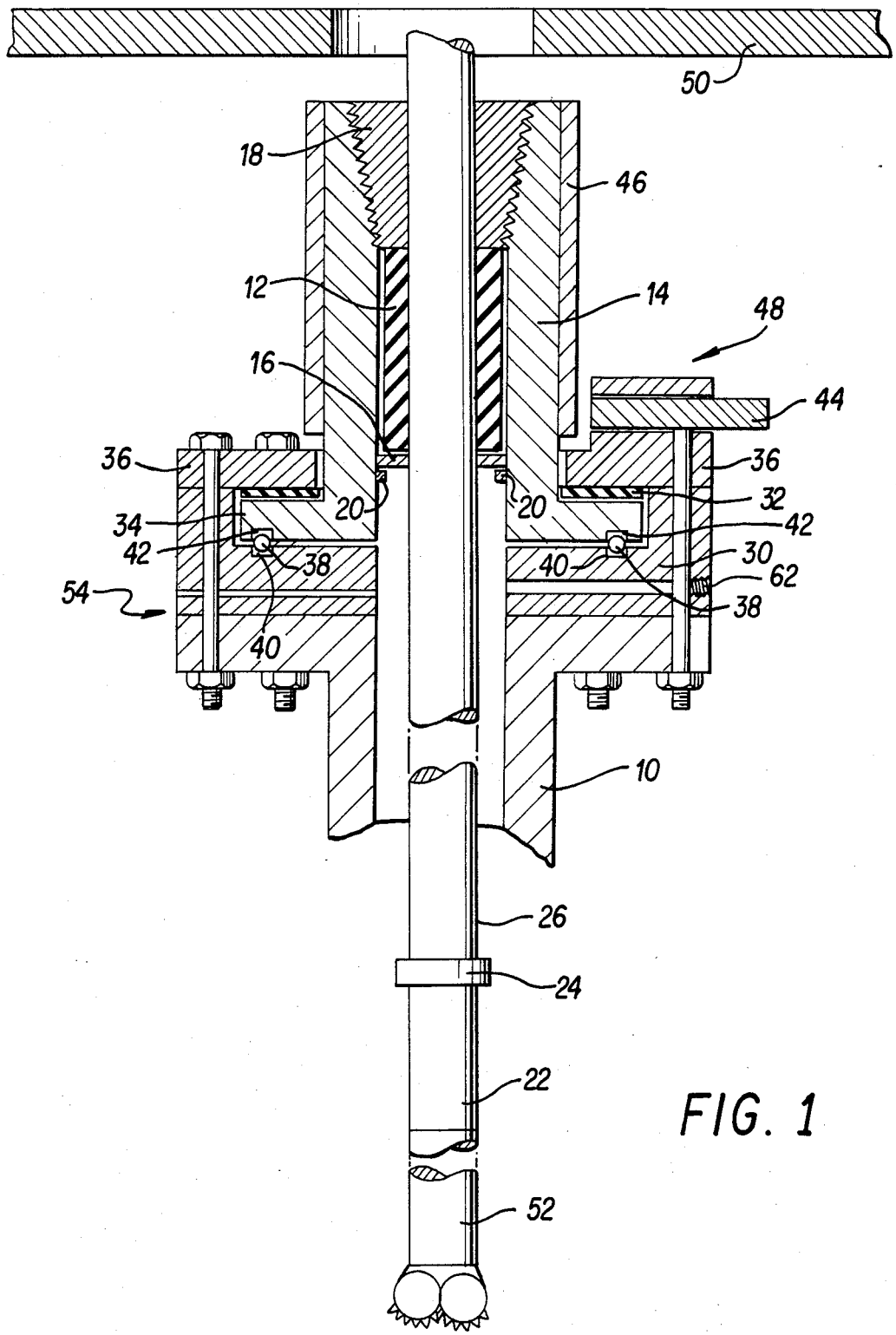
FIG. 1 is a cross sectional view of the housing and contents of the fire control system and blow-out protector of the present invention.
Figure 2:
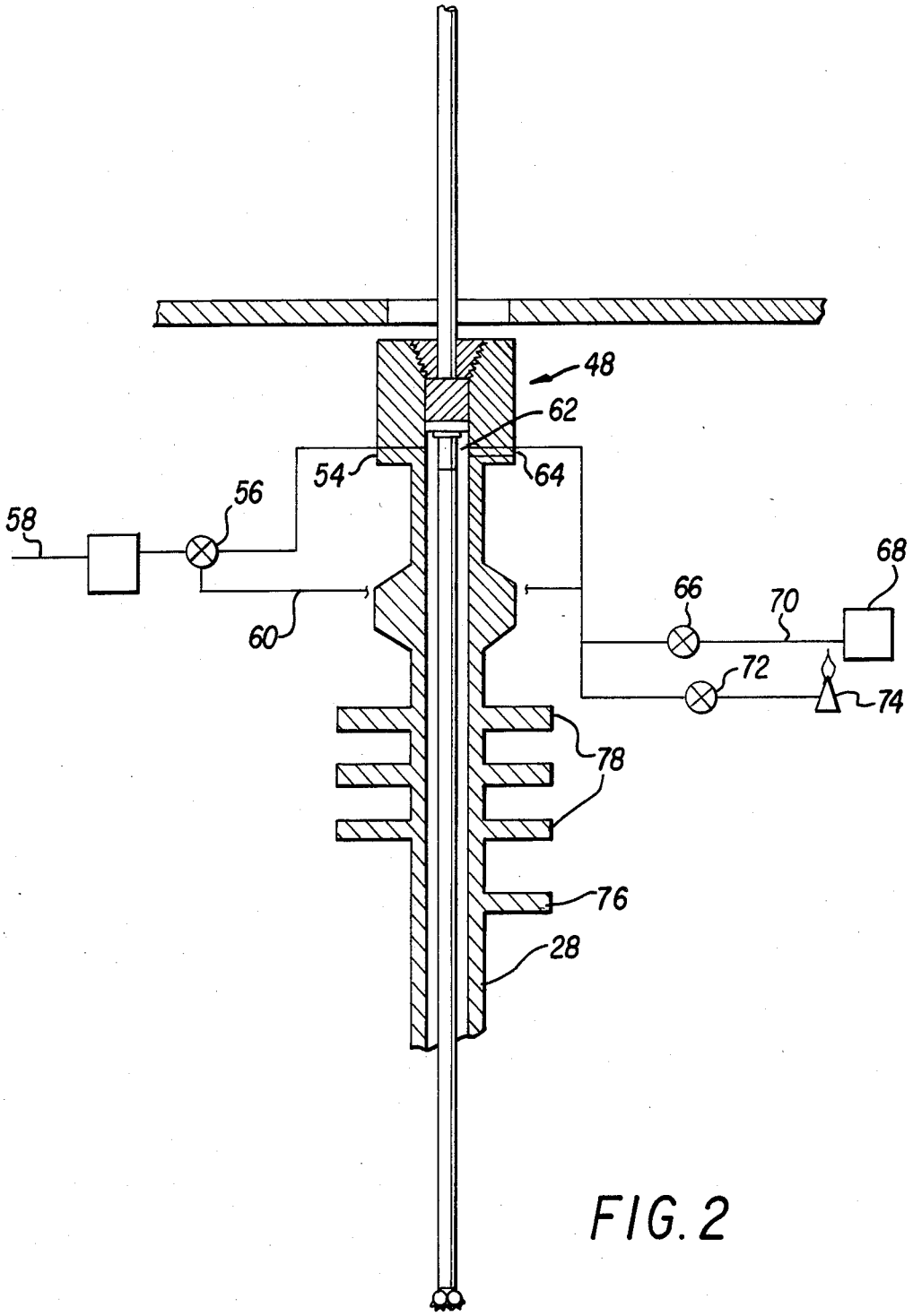
FIG. 2 is a schematic view of the drilling stack with the blow-out protector activated.

FIGS. 1 and 2 illustrate the preferred embodiment of the fire control system and blow-out protector of the present invention, fixedly secured to a well casing by adapter flange 10 connected to a housing 14, 30 having a vertical passageway therethrough for a drill pipe 52.

The blow-out protector is made up of an elastomeric material such as rubber Kelly bushing and seal 12 held in a rotating Kelly flange assembly 14 by compressor ring 16 at the bottom and Kelly lock 18 at the top for providing sealing contact with a drill pipe 52 extending through the housing. Compressor ring plate 16 is prevented from falling down by ridge 20 on rotating Kelly flange assembly 14. Positioned on Kelly sub 22 is catch ring 24 for rubber Kelly bushing and seal 12. In order to seal the Kelly flange assembly 14 against leakage of high pressure fluid Kelly sub 22 is retracted upward causing catch ring plate 24 to move compressor ring 16 upward, which in turn compresses rubber Kelly bushing and seal 12 causing it to seal the space between rotating Kelly flange assembly 14 and Kelly 26. This basically prevents a blow-out through the casing 28.

As a secondary precaution a seal is also provided between the rotating Kelly flange assembly 14 and the flange housing 30. This is accomplished by a rubber gasket 32 positioned above a lateral extension 34 of rotating Kelly flange assembly 14 and below a lateral flange 36 of flange housing 30.

In order to achieve secondary sealing, kelly sub 22 is retracted upward causing catch ring 24 to move compressor ring 16 upward, which in turn moves lateral extension 34 of rotating Kelly flange assembly 14 upward which compresses rubber gasket 32 against lateral flange 36 of flange housing 30. When not sealed the rotating Kelley flange assembly 14 rotates in flange housing 30 on bearings 38 which run in races 40 and 42. Rotation can be prevented by placing dog lock 44 in contact with flange ear 46. The above components form an assembly 48 below derrick floor 50.

To protect against a blow-out when drill string 52 is removed from the well, Kelly 26 is returned to the well without the drill string.

In addition to the blow-out protector, the assembly 48 also contains a fire control system. Heat sensor 54 in flange housing 30 detects any abnormally high temperature in assembly 48. If an abnormally high temperature is sensed a valve 56 is opened and inert gas such as carbon dioxide if fed through line 60 to inert gas inlet 62 to mix with oil and gas in the casing. If an unusually high pressure is sensed by sensor 64, valve 66 is opened to allow gas and oil to go to storage 68 through line 70 or valve 72 is opened to allow flaring off of the gas and or oil at flare 74. Flare 74 is remote from the well so as not to ignite any gas that might escape from the well.

The well contains conventional components such as mud return 76, blow-out preventers 78, and hydril 80.

What is claimed is:

1. A blow-out protector for an oil well comprising a housing having a vertical passageway therethrough for a Kelly, the housing having a lower end adapter flange to be connected to a well casing, an elastomeric body having an opening for the Kelly and carried on the Kelly for providing sealing contact with the Kelly and housing passageway, a catch ring secured to the Kelly and having a surface defined by a given diameter, a compressor ring plate positioned below the elastomeric body on the Kelly, means on an interior of the housing having a given diameter and preventing the compressor ring plate from falling down and yet providing engagement with the surface of the catch ring, the compressor ring plate having a hole for passage of the Kelly drive-mechanism for the drill pipe, the catch ring on the Kelly positioned below the compressor plate, the diameter of the catch ring being smaller than the diameter of the interior means on the housing so that when the Kelly is pulled up the catch ring will contact and force the compressor ring plate against the elastomeric body and force the elastomeric body into tight contact with both the Kelly and the housing thus sealing the space between the Kelly and the housing against a blow-out.

2. The blow-out protector of claim 1 wherein the improvement further comprises a lateral fluid conduit positioned on the housing below the elastomeric body, means for introducing a non-flammable fluid into the lateral fluid conduit and a means for withdrawing fluid from the lateral fluid conduit, the means for introducing and the means for withdrawing being sequential and not simultaneous.

3. The blow-out protector of claim 2 wherein the improvement further comprises a means for transporting withdrawn fluid from the lateral fluid conduit to a site remote from the well.

4. The blow-out protector of claim 2 wherein the improvement further comprises injecting a fire extinguishing fluid into the lateral fluid conduit and withdrawing flammable fluid from the drill pipe and storing or flaring the flammable fluid which was withdrawn.

5. A blow-out protector for an oil well comprising a tubular body having a lower end adapter flange to be connected to a well casing and provided with a lateral fluid conduit, an elastomeric body having a vertical opening for a Kelly, the elastomeric body carried on the Kelly above the lateral conduit for sealing contact with the Kelly extending through and spaced from inner walls of both the casing and the tubular body, a catch ring secured on the Kelly and having a surface defined by given radius, a compressor ring plate positioned below the elastomeric body, means on an interior of the tubular body of a given diameter and preventing the compressor ring plate from falling down and yet providing engagement with the surface of the catch ring, the compressor ring plate having a hole for passage of the Kelly therethrough, the diameter of the catch ting being smaller than the diameter of the interior means within the tubular body so that when the Kelly is pulled up the catch ring will contact and force the compressor ring plate against the elastomeric body and force the elastomeric body into tight contact with both the Kelly and the inner wall of the tubular body thus sealing the well against a blow-out.

6. A fire control system for an oil well including a blow-out protector for the oil well comprising a tubular body having a lower end adapter flange to be connected to a well casing and provided with a lateral fluid conduit.

an elastomeric body having a vertical opening for a Kelly, the elastomeric body carried in the Kelly above the lateral conduit for sealing contact with the Kelly extending through and spaced from inner walls of both the casing and the tubular body, a catch ring secured on the Kelly and having a surface defined by a given diameter, a compressor ring plate positioned below the elastomeric body, means on an interior of the tubular body of a given diameter and preventing the compressor ring plate from falling down and yet providing engagement with the surface of the catch ring, the compressor ring plate having hole for passage of the Kelly therethrough and carried with the Kelly, the diameter of the catch ring plate being smaller than the diameter of the interior means within the tubular body so that when the Kelly is pulled up the catch ring will contact and force the compressor ring plate against the elastomeric body and force the elstomeric body into tight contact with both the Kelly and the inner wall of the tubular body thus sealing the well against a blow-out, a means for introducing a non- flammable fluid into the lateral fluid conduit, and a means for withdrawing fluid from the lateral fluid conduit, the means for introducing and the means for withdrawing being sequential and not simultaneous.

7. A fire control system for an oil well including a blow-out protector for the oil well comprising a tubular body having a lower end adapter flange to be connected to a well casing and provided with a lateral fluid conduit.

an elastomeric body having a vertical opening for a Kelly, the elastomeric body carried on the Kelly above the lateral conduit for sealing contact with the Kelly extending through and spaced from inner walls of both the casing and the tubular body, a catch ring secured on the Kelly and having a surface defined by a given diameter, a compressor ring plate positioned below the elastomeric body on the Kelly, means on an interior of the tubular body of a given diameter and preventing the compressor ring plate from falling down and yet providing engagement with the surface of the catch ring, the compressor ring plate being smaller than the diameter of the interior means within the tubular body so that when the Kelly is pulled up the catch ring will contact and force the elastomeric body into tight contact with both the Kelly and an inner wall of the tubular body thus sealing the well against a blow-out.

a lateral fluid conduit, a means for introducing a non- flammable fluid into the lateral fluid conduit, and a means for withdrawing fluid from a well pipe in the casing, the means for introducing and the means for withdrawing being sequential or simultaneous.

* * * * *